US008574370B2

(12) United States Patent
Laffitte et al.

(10) Patent No.: US 8,574,370 B2
(45) Date of Patent: Nov. 5, 2013

(54) USE OF ALKANE SULPHONIC ACID FOR RUST REMOVAL

(75) Inventors: Jean-Alex Laffitte, Pau (FR); Bernard Monguillon, Mourenx (FR)

(73) Assignee: Arkema France, Colombes (FR)

( * ) Notice: Subject to any disclaimer, the term of this patent is extended or adjusted under 35 U.S.C. 154(b) by 0 days.

(21) Appl. No.: 12/811,413

(22) PCT Filed: Nov. 27, 2009

(86) PCT No.: PCT/FR2009/052321

§ 371 (c)(1),
(2), (4) Date: Aug. 27, 2010

(87) PCT Pub. No.: WO2010/061146

PCT Pub. Date: Jun. 3, 2010

(65) Prior Publication Data

US 2011/0214690 A1 Sep. 8, 2011

(30) Foreign Application Priority Data

Nov. 28, 2008 (FR) ..... 08.58129

(51) Int. Cl.

| | |
|---|---|
| ***B08B 3/00*** | (2006.01) |
| ***C23G 1/02*** | (2006.01) |
| ***C11D 3/02*** | (2006.01) |

(52) U.S. Cl.
USPC ..... 134/3; 134/2; 134/26; 134/28; 134/41; 510/363

(58) Field of Classification Search
None
See application file for complete search history.

(56) References Cited

U.S. PATENT DOCUMENTS

| | | | | |
|---|---|---|---|---|
| 4,828,743 | A * | 5/1989 | Rahfield et al. | 510/363 |
| 2006/0287209 | A1 * | 12/2006 | Chaigne et al. | 510/238 |
| 2007/0203049 | A1 * | 8/2007 | Thomson | 510/421 |

OTHER PUBLICATIONS

International Search Report with English Translation received in PCT/FR2009/052321 mailed on Feb. 19, 2010.

* cited by examiner

*Primary Examiner* — Nicole Blan
(74) *Attorney, Agent, or Firm* — Smith, Gambrell & Russell, LLP

(57) ABSTRACT

The present invention relates to the use of at least one alkane sulphonic acid, with formula R—$SO_3H$, where R represents a saturated, linear or branched hydrocarbon chain, comprising 1 to 4 atoms of carbon for removing rust from all types of surface, in particular from metal surfaces, specifically iron, steel and others. The invention also relates to a method for cleaning rust from all types of surfaces using at least one alkane sulphonic acid.

18 Claims, No Drawings

USE OF ALKANE SULPHONIC ACID FOR RUST REMOVAL

The present invention relates to the field of the cleaning of rust on all types of surfaces and in particular metal surfaces, especially surfaces made of iron, steel and others. More particularly, the invention relates to the use of alkanesulfonic acid for removing rust and rust stains on all types of surfaces, metal or nonmetal, and in particular rust present on sheets made of metal, cables, tubes, pipes, bars, girders and others.

The invention also relates to a method for removing rust or rust stains present on said surfaces, in particular metal surfaces, in other words to a method for cleaning or reexposing surfaces completely or partially covered by rust.

Iron and more particularly steel is today very widely used in many industries, in the form of cables, in particular for construction, of electrical cables, in the form of sheets, tubes, poles, bolts, nuts, nails or springs, in the construction industry (bars, girders and others), transportation (motor vehicles, trains, airplanes, boats, and the like), or also in the form of tubes, pipes and others for the transportation of fluids, such as liquids (water, wastewater, rainwater, sewage or oil), or of gas (inter alia natural gas), containers (casks, cans, boxes and others), items of equipment, tools or metal furniture.

Under the action of atmospheric oxygen and of ambient moisture, of sea air, iron and materials comprising it, such as steel, undergo natural oxidation, resulting in the formation of surface rust. It is often necessary to remove this layer of rust (reference is then made to "reexposing"), not only for aesthetic reasons but also and in particular to have available suitable and cleaned surfaces, for the purpose of the assembling thereof (welding operation, adhesive bonding, and the like), in order to allow them to be coated with various protective layers (passivation, paint, and the like), or for any other use of these materials.

The rust formed at the surface of metals can also be deposited by contact on other nonmetal surfaces, thus bringing about undesirable rust stains on these nonmetal surfaces.

In order to remove the rust present on metal surfaces, indeed even nonmetal surfaces, various acid-based formulations are used today.

The acid most commonly used in this application is phosphoric acid, the phosphate discharges of which represent a major problem for the environment. Specifically, the use of phosphoric acid is today disputed due to the discharges of phosphate type which it generates.

Likewise, sulfanic acid, the discharges of which are also regarded as harmful to the environment, in particular for aquatic organisms, is not an acid which can be widely used industrially in order to remove rust.

Nitric acid is also used to remove rust from metals. However, in addition to its strong "acid" power, nitric acid is a powerful oxidizing agent and for this reason is only very rarely used in large amounts, in particular for obvious reasons of safety of the users. In addition, nitric acid is categorized as toxic in the "Federal Caustic Poison Act", even in the diluted form, for all solutions at concentrations of greater than at least 5%.

Hydrochloric acid (also known as muriatic acid) is used to remove rust but the vapors given off are irritating and toxic to the user.

The use has also been envisaged of organic acids, such as, for example, acetic acid, citric acid, oxalic acid, glycolic acid, lactic acid, formic acid and the like. However, as their acidity is lower than that of the abovementioned inorganic acids, their effectiveness is lower and often unsatisfactory and requires the use of larger amounts of products. Furthermore, some are categorized as harmful, such as oxalic acid and glycolic acid.

In addition, some acids are provided in the solid form, which results in difficulties in handling (pulverulent powders) and in formulating.

A need thus remains for products which make it possible to be freed from the disadvantages listed above, in particular acids which make it possible to efficiently remove rust while protecting the environment, which are in accordance with the environmental standards in force and which do not exhibit the disadvantages related to the oxidizing power of nitric acid or to the releases of irritant gases related to the use of hydrochloric acid.

Thus, a first object of the present invention consists in providing an effective alternative to the use of the abovementioned acids, in particular phosphoric acid, hydrochloric acid and nitric acid, for removing rust, in particular rust present on all types of surfaces, especially on metal surfaces, or all types of articles, such as sheets made of metal, cables, tubes, pipes and others.

Another object of the present invention consists in providing an effective alternative to the acids commonly used in this application while avoiding discharges and effluents harmful to the environment.

Other objects and advantages will become apparent during the description of the present invention which follows. These objects are achieved in all or in part by virtue of the present invention.

This is because the Applicant Company has now discovered that the use of alkanesulfonic acids makes it possible to remove rust and rust stains on all types of surfaces in an efficient manner without exhibiting the abovementioned disadvantages, in particular the disadvantages with regard to the environment, the disadvantages related to gas releases and others, as will now be described.

It has thus been discovered that it is possible to efficiently remove rust by using a formulation based on at least one alkanesulfonic acid.

The formulations based on at least one alkanesulfonic acid exhibit in particular an improved effectiveness with respect to the phosphoric acid normally used for the removal of rust.

In addition, the use of alkanesulfonic acid(s) is less harmful to the environment, in comparison with the discharges of phosphates inherent in the use of phosphoric acid.

Thus, according to a first subject matter, the invention relates to the use of at least one alkanesulfonic acid for the removal of rust which may be present on surfaces of any type, in particular metal surfaces, and in particular on surfaces of sheets, cables, tubes, pipes and others.

Thus, the use according to the invention provides an effective alternative, and one which is in accordance with environmental regulations, to the use of phosphoric acid normally used under these conditions.

More specifically, the present invention provides a replacement product for phosphoric acid for the cleaning of metal surfaces, in particular for the removal of rust, said replacement product being biodegradable, less toxic to the environment and more effective and being able to be used in smaller amounts, while providing a comparable, indeed even better, effectiveness.

Within the meaning of the present invention, the term "rust" is understood to mean the product of corrosion by oxygen and by water of iron and metals comprising iron, in particular steel. These corrosion products are in particular iron(II) oxides and hydroxides, iron(III) oxides and hydroxides, optionally in the form of hydrates, and for example $Fe_2O_3$, FeO(OH), $Fe(OH)_3$ or $Fe_2O_3.nH_2O$.

In the present invention, the term "alkanesulfonic acid" is understood to mean preferably alkanesulfonic acids of formula R—$SO_3H$, where R represents a saturated and linear or branched hydrocarbon chain comprising from 1 to 4 carbon atoms.

The alkanesulfonic acids which can be used in the context of the present invention are preferably chosen from methanesulfonic acid, ethanesulfonic acid, n-propanesulfonic acid, isopropanesulfonic acid, n-butanesulfonic acid, isobutanesulfonic acid, sec-butanesulfonic acid, tert-butanesulfonic acid and the mixtures of two or more of them in all proportions.

According to a preferred embodiment, the alkanesulfonic acid used in the context of the present invention is methanesulfonic acid or ethanesulfonic acid; entirely preferably, the acid used is methanesulfonic acid.

Thus, the use according to the present invention employs at least one alkanesulfonic acid chosen from alkanesulfonic acids possessing a linear or branched chain comprising from 1 to 4 carbon atoms and preferably at least methanesulfonic acid (MSA).

Any type of formulation comprising at least one alkanesulfonic acid may be suitable, it being possible for the alkanesulfonic acid(s) to be used in the pure form or in the form diluted using various components, as indicated below. As a general rule, the formulation comprises from 0.01 to 100% by weight of alkanesulfonic acid, more generally from 0.05 to 90% by weight, in particular from 0.5 to 75% by weight, of alkanesulfonic acid, with respect to the total weight of said formulation.

The concentration of alkanesulfonic acid(s) in the formulation depends on many factors, among which may be mentioned the amount of rust or rust stains to be cleaned, the nature and the form of the surface to be cleaned, the temperature at which the formulation is applied and others. A person skilled in the art will know how to adjust the concentration of acid in the formulation without excessive efforts.

Preference is given to concentrated solutions, for example of 60 to 100% by weight, preferably approximately from 70 to 100% by weight, of alkanesulfonic acid, with respect to the total weight of said formulation, when it is desired to remove large amounts of rust, in particular at the surface of metals, or at the surface of materials which are relatively insensitive to acid attacks. Preference is given to less concentrated solutions of 0.01 to 60%, preferably of 0.05 to 50%, for smaller amounts of rust to be removed or for the cleaning of rust stains on surfaces, in particular nonmetal surfaces, sensitive to acid attacks.

The formulation is, for example, an aqueous, organic or aqueous/organic formulation which can be prepared in the form of a concentrated mixture or concentrate which can be diluted by the final user. In an alternative form, the formulation can also be a ready-for-use formulation, that is to say that it does not have to be diluted.

Use may be made, for example, of methanesulfonic acid in aqueous solution sold by Arkema under the name Scaleva® or also under the name Lutropur® sold by BASF, ready-for-use or diluted with water in the proportions indicated above.

In addition to the alkanesulfonic acid or acids, the formulation used in the present invention can optionally comprise one or more additives, such as those chosen from:

- hydrotropic or solubilizing agents or solvents (for example alcohols, esters, ketones, amides and others),
- biocides or disinfectants (bromoacetic acid, peracetic acid, aqueous hydrogen peroxide solution and others),
- rheological or texturizing or thickening or gelling agents (sugars, polysaccharides, alginates, silica, amorphous silica, gums and others),
- organic or inorganic acids (for example sulfuric acid, phosphoric acid, nitric acid, sulfamic acid, acetic acid, citric acid, formic acid, lactic acid, glycolic acid, oxalic acid and others),
- flame retardants,
- preservatives,
- surfactants of anionic, cationic, nonionic or amphoteric type (such as ethoxylated alcohols and/or amines, or alkyl- and/or arylsulfonates), emulsifiers, detergents, soaps and others,
- foaming or antifoaming agents,
- antifreezes (for example ethylene glycol, propylene glycol and others),
- colorants,
- fragrances or odorous agents, and other additives known to a person skilled in the art.

According to an alternative form, the formulation is a formulation in the gel form. This is because it has been observed that the formulations in the gel form of alkanesulfonic acid(s) are very effective in the removal of rust, not only due to the gel itself, which makes possible a longer action of the acid active principle (the gel "adheres" for a longer time to the surfaces, in comparison with an aqueous formulation), but also exhibits an improved cleaning power, in comparison with other gel formulations, for example formulations in the phosphoric acid gel form.

Thus, according to another aspect, the present invention relates to the use of a formulation in the gel form comprising:

- from 0.01 to 97% by weight, preferably from 0.05 to 75% by weight and more particularly from 0.5 to 70% by weight of at least one alkanesulfonic acid, preferably methanesulfonic acid;
- from 0.1 to 30% by weight, preferably from 0.5 to 15% by weight and more particularly from 1 to 10% by weight of at least one gelling agent;
- from 0 to 30% by weight, preferably from 0.5 to 15% by weight, of at least one additive chosen from those mentioned above; and
- the remainder to 100% of water and/or organic solvent.

The gelling agents and the surfactants which can be used in the formulations in the gel form can be of any type. A person skilled in the art will know how, without particular difficulty and drawing inspiration from the following examples, to choose and adapt the nature of the gelling agents and surfactants which are appropriate.

According to another aspect, the present invention relates to the use of a formulation in the foaming gel form. This is because foaming gels are very particularly advantageous due to the fact that they produce a clinging foam, in other words an adherent foam, at the rusted surfaces, while requiring a reduced consumption of cleaning acid active material, and exhibit the advantage of a better ability to be rinsed off, that is to say simpler and more efficient removal, while requiring a smaller amount of water.

Thus, the present invention relates to the use of a formulation in the foaming gel form comprising:

- from 0.01 to 97% by weight, preferably from 0.05 to 75% by weight and more particularly from 0.5 to 70% by weight of at least one alkanesulfonic acid, preferably methanesulfonic acid;
- from 0.1 to 30% by weight, preferably from 0.5 to 15% by weight and more particularly from 1 to 10% by weight of at least one foaming agent;

from 0 to 30% by weight, preferably from 0.5 to 15% by weight and more particularly from 1 to 10% by weight of at least one gelling agent;

from 0 to 30% by weight, preferably from 0.5 to 15% by weight, of at least one additive chosen from those mentioned above, including preferably from 0 to 10% by weight, preferably from 0.1 to 5% by weight, of a solubilizing or hydrotropic agent and from 0 to 20% by weight, preferably from 0.5 to 10% by weight, of at least one surfactant; and the remainder to 100% of water and/or organic solvent.

Depending on the field and the method of application, the formulation can be prepared in the concentrate form and with an appropriate viscosity and can then be diluted before use until the expected effectiveness with regard to the viscosity and the foaming power is obtained.

In the above foaming gel formulation, the foaming agent can be chosen from the foaming agents commonly used by a person skilled in the art and preferably from amine oxides, such as, for example:

dimethylalkylamine oxides, the alkyl chain being a "fatty" chain comprising, for example, from 10 to 30 carbon atoms, preferably from 12 to 22 carbon atoms;

ethoxylated amine oxides; and mixtures of two or more of them.

The use of at least one ethoxylated amine oxide, such as, without implied limitation, Cecajel®OX100 from CECA or Aromox® T12 from Akzo, alone or in combination with at least one dimethylalkylamine oxide, makes it possible to contribute stability to the foaming gel.

Foaming agents, in particular those described above, generally form gels when they are mixed with water, that is to say that they increase the viscosity of the formulation without it being necessary to add a gelling agent. However, the addition of such a gelling agent is not excluded from the present invention.

Mention may be made, among solubilizing or hydrotropic agents which can be used in the formulations according to the invention, by way of example and without implied limitation, of sodium xylene- or cumenesulfonates. However, such agents are not essential in the acid formulations according to the invention.

An aqueous, organic or aqueous/organic formulation in the solution or gel form or also in the foaming gel form which is particularly preferred is a formulation comprising from 0.01 to 97% by weight, preferably from 0.05 to 75% by weight and more preferably from 0.5 to 70% by weight of methanesulfonic acid.

The formulations used according to the present invention, whether in liquid, gel or foaming gel form or in the concentrated or diluted form, can be applied according to any method known to a person skilled in the art and in particular under pressure or also using a spray gun.

According to another aspect, the present invention relates to a method for removing rust, for example present in the form of a layer or layers or simply of a stain or stains, comprising at least one stage in which an effective amount of at least one alkanesulfonic acid as defined above, preferably methanesulfonic acid, is brought into contact with the rust to be removed, by contact, immersion, sprinkling, spraying or application of a more or less thick layer, optionally using appropriate tools known to a person skilled in the art (brushes, including fine brushes, spatulas and others), said stage of bringing into contact being optionally followed by one or more stages of rinsing and/or drying.

The temperature at which the process is carried out can vary within wide limits and is generally between −20° C. and +150° C., preferably between 0° C. and 80° C., more preferably between 10° C. and 80° C. According to a preferred embodiment, the operating temperature is ambient temperature or else a temperature between ambient temperature and approximately 80° C. It is thus possible to envisage bringing to temperature the alkanesulfonic acid and the surface to be treated, it being possible for this temperature to be identical or different, or to bring to temperature either the alkanesulfonic acid or the surface to be treated.

It is thus possible to treat externally rusted steel sheets at ambient temperature (for example 10° C.) using a formulation of alkanesulfonic acid(s) brought to 70° C. or also to treat metal cables at a high temperature (for example more than 100° C.) using a formulation of alkanesulfonic acid(s) at ambient temperature (for example 20° C.). It is also possible to envisage completely immersing the surfaces to be treated in a formulation of alkanesulfonic acid(s) brought, for example, to a temperature of approximately 60° C., for example in order to remove rust stains present on textiles, which may or may not be coated, plastic films and others.

Finally, after the stage of treatment(s) and of optional rinsing operation(s), the cleaned surface can, if appropriate and if necessary, be dried according to any method known to a person skilled in the art, for example with air, under a stream of more or less hot air, in an oven, by heating (electrical, heating lamps), wiping (absorbent textiles or papers) and others.

As indicated above, the alkanesulfonic acid is advantageously employed in the form of a formulation, for example an aqueous, organic or aqueous/organic formulation, in the liquid, gel or foaming gel form, as defined above.

In the method of the invention as just described, the term "effective amount" is understood to mean an amount which makes possible the dissolution of the rust and the removal of all traces of rust.

This amount can vary within wide limits according to the surfaces to be treated and the amount of rust, the temperature and the pressure of the formulation used, the desired duration of the removal method, and others.

Thus, the amount of acid will advantageously be worked out in order to make possible complete removal of the rust while observing a minimum amount of acid(s), essentially for economic reasons.

The method for the removal of rust can be repeated one or more times according to the amount of rust to be removed and its degree of encrustation.

The operation of bringing into contact an effective amount of at least one alkanesulfonic acid is followed by a reaction time necessary for the dissolution of the rust or rust stains, it being possible for this reaction time to vary from a few seconds to a few hours, indeed even a few days, according to the temperature at which the cleaning is carried out, the pressure of application of the alkanesulfonic acid(s), the amount of rust to be removed and its degree of encrustation, and the nature of the surface to be treated.

The treatment by at least one alkanesulfonic acid as just defined can optionally be accompanied and/or followed by one or more mechanical operations (agitation, scraping, brushing and others) in order to improve the acid chemical action, if necessary.

Finally, the treatment can be followed by one or more rinsing operations, for example with clear water, solvent(s) or water/solvent mixture(s).

Alkanesulfonic acids, in particular methanesulfonic acid, have been shown to be more effective than phosphoric acid in the removal of rust and rust stains, which makes it possible to use smaller amounts of acids which are more respectful to the environment: the effluents (residues, salts and others) resulting from a cleaning operation using at least one alkanesulfonic acid are biodegradable, in contrast to the phosphoric acid commonly used today, which generates phosphates responsible, inter alia, for phenomena of eutrophication of rivers, watercourses and reserves of water, such as lakes, marshes, ground water, and the like.

Furthermore, no release of nauseating or irritating gas could be observed under the operating conditions. In addition, the alkanesulfonic acids used in the present invention exhibit, with respect to arylsulfonic acids, the advantage of generating a smaller oxygen demand in effluent treatment plants (Chemical Oxygen Demand, COD) and consequently of making possible a higher concentration of organic discharges in said plants.

The present invention described above shows that it is possible to remove rust on all types of surfaces or to clean rust stains present on all types of surfaces, whether metal or non-metal, such as polymers, textiles, wood and others. As non-limiting examples, the surfaces are chosen from metals (iron, steel, copper, alloys and others), polymers (plastics, paints, varnishes, lacquers, and the like), concrete, cement, tiling, porcelain, wood, paper, board, textiles glass and others.

Thus, alkanesulfonic acids can advantageously be used as replacement for the acids commonly used for the removal of rust and rust stains in a large number of fields of application, among which may be mentioned, without implied limitation, the fields of construction (sheets, bolts, nuts, screws, nails, springs, bars, girders and others), cable manufacture, for example the manufacture of electric cables, transportation (motor vehicles, trains, airplanes, boats, and the like), transportation of fluids, such as water, wastewater, rainwater, sewage or oil, or of gas, inter alia natural gas (tubes, pipes and others), containers (casks, cans, boxes and others), items of equipment, tools or metal furniture, to mention only some of them.

It should be understood that the use according to the present invention makes possible not only the cleaning of rust but also concomitantly the cleaning of other type(s) of contaminant(s) which may be present on the surfaces to be treated, due to the acid nature of the alkanesulfonic acids used.

For example, the alkanesulfonic acids used in the context of the present invention may prove to be effective in cleaning electric cables made of copper which are contaminated by various metal oxides, in particular copper oxides, or in removing organic contaminants (animal feces and droppings), scale and others.

The present invention is now illustrated by means of the examples which follow, without exhibiting any limiting nature, and which consequently cannot be understood as capable of restricting the scope of the invention as claimed.

EXAMPLE 1

In order to assess the effectiveness of alkanesulfonic acids in the removal of rust, dissolution tests were carried out on ferric oxide $Fe_2O_3$ (Aldrich 2008), in the powder form (5 μm, purity>99%), according to the following protocol:

6 g of ferric oxide and 100 g of an aqueous solution of methanesulfonic acid (Scaleva®, sold by Arkema) at various concentrations are added to a flask. At the same time, comparative tests are carried out with 100 g of an aqueous solution of phosphoric acid (Normapur, sold by VWR), at the same various concentrations.

The flask is closed with a stopper and then placed in a stirred bath at 70° C. for 24 hours.

The solution is subsequently cooled and then filtered through a membrane filter (Acrodisc®, with a diameter of 25 mm and a porosity of 0.2 μm). The filtrate is quantitatively determined by ICP (emission spectroscopy) in order to evaluate the content of iron in the filtrate. The higher the content of iron in the filtrate, the better the effectiveness of the acid in removing the rust.

The results are presented in the following table 1:

TABLE 1

| Acid | Concentration (% by weight in water) | Content of $Fe^{2+}$ (% by weight) |
|---|---|---|
| Scaleva ® | 1 | 0.004 |
| Scaleva ® | 5 | 0.100 |
| Scaleva ® | 10 | 0.400 |
| Scaleva ® | 15 | 0.900 |
| $H_3PO_4$ | 1 | 0.005 |
| $H_3PO_4$ | 5 | 0.014 |
| $H_3PO_4$ | 10 | 0.023 |
| $H_3PO_4$ | 15 | 0.250 |

It is found that methanesulfonic acid is more effective than phosphoric acid and in particular up to 17 times more effective for concentrations of 10% by weight in water.

EXAMPLE 2

The high effectiveness of alkanesulfonic acid in comparison with phosphoric acid was also observed and confirmed during a test carried out on a rusted nail, with approximately a length of 2 cm and a diameter of 0.1 cm, immersed in a 10% aqueous methanesulfonic acid solution for two hours at ambient temperature.

After rinsing with clear water, the nail no longer comprises any trace of rust.

What is claimed is:

1. A method of removing rust from a surface, which comprising contacting the rust with a composition consisting essentially of at least one alkanesulfonic acid of formula R—SO3H, wherein R represents a saturated and linear or branched hydrocarbon chain comprising from 1 to 4 carbon atoms, and optionally contacting the rust with one or more additives selected from the group consisting of: hydrotropic agents, solubilizing agents, gelling agents, solvents, biocides, disinfectants, rheological agents, texturizing agents, thickening agents, organic acids, inorganic acids, flame retardants, preservatives, anionic surfactants, cationic surfactants, nonionic surfactants, amphoteric surfactants, emulsifiers, detergents, soaps, foaming agents, anti-foaming agents, antifreezes, colorants, fragrances, and odorous agents, and optionally followed by one or more stages of rinsing and/or drying.

2. The method as claimed in claim 1, wherein the alkanesulfonic acid is selected from the group consisting of methanesulfonic acid, ethanesulfonic acid, n-propanesulfonic acid, isopropanesulfonic acid, n-butanesulfonic acid, isobutanesulfonic acid, sec-butanesulfonic acid, tert-butanesulfonic acid, and the mixtures of two or more of them in all proportions.

3. The method as claimed in claim 1, wherein the alkanesulfonic acid is methanesulfonic acid or ethanesulfonic acid.

4. The method as claimed in claim 1, wherein the at least one alkanesulfonic acid is provided in the composition having a concentration of the at least one alkanesulfonic acid that is (a) between 0.1 and 100% by weight, (b) between 0.5 and 90% by weight, or (c) between 0.5 and 75% by weight, with respect to the total weight of said composition.

5. The method as claimed in claim 1, wherein the composition is an aqueous, organic or aqueous/organic formulation which is concentrated, ready-for-use or to be diluted before use.

6. The method as claimed in claim 1, wherein the composition is a liquid, gel or foaming gel formulation.

7. The method as claimed in claim 1, wherein an effective amount of the at least one alkanesulfonic acid is contacted with the rust to be removed, by sprinkling, spraying or spreading the at least one alkanesulfonic acid on the rust to be removed or immersing the rust to be removed in the at least one alkanesulfonic acid.

8. The method as claimed in claim 7, wherein the contacting is carried out at (a) a temperature between −20° C. and +150° C., (b) a temperature between 0° C. and 80° C., (c) a temperature between 10° C. and 80° C., (d) ambient temperature, or (e) a temperature between ambient temperature and approximately 80° C.

9. The method as claimed in claim 1, wherein the surface is metal, a metal alloy, nonmetal, concrete, cement, tiling, porcelain, wood, paper, a board, a textile, plastic, or glass.

10. The method as claimed in claim 9, wherein the metal is iron, steel, or copper.

11. The method as claimed in claim 1, wherein the additive is an alcohol, an ester, a ketone, an amide, bromoacetic acid, peracetic acid, an aqueous hydrogen peroxide solution, a sugar, a polysaccharide, an alginate, a silica, an amorphous silica, a gum, sulfuric acid, phosphoric acid, nitric acid, sulfamic acid, acetic acid, citric acid, formic acid, lactic acid, glycolic acid, oxalic acid, an ethoxylated alcohol, an ethoxylated amine, an alkylsulfonate, an arylsulfonate, ethylene glycol, or propylene glycol.

12. A method of removing rust from a surface, which comprises contacting the rust with a composition that consists essentially of an amount of at least one alkanesulfonic acid of formula R—SO3H, wherein R represents a saturated and linear or branched hydrocarbon chain comprising from 1 to 4 carbon atoms.

13. The method of claim 12, wherein the amount of the at least one alkanesulfonic acid is 0.01 to 100% of the total weight of the composition.

14. The method of claim 12, wherein the amount of the at least one alkanesulfonic acid is 0.05 to 90% of the total weight of the composition.

15. The method of claim 12, wherein the amount of the at least one alkanesulfonic acid is 0.5 to 75% of the total weight of the composition.

16. The method of claim 12, wherein the composition further comprises one or more additives selected from the group consisting of hydrotropic agents, solubilizing agents, gelling agents, solvents, biocides, disinfectants, rheological agents, texturizing agents, thickening agents, organic acids, inorganic acids, flame retardants, preservatives, anionic surfactants, cationic surfactants, nonionic surfactants, amphoteric surfactants, emulsifiers, detergents, soaps, foaming agents, anti-foaming agents, antifreezes, colorants, fragrances, and odorous agents, and wherein the composition still contains the amount of the at least one alkanesulfonic acid.

17. The method of claim 12, whereby an effective amount of the amount of the at least one alkanesulfonic acid is contacted with the rust.

18. The method of claim 17, wherein the alkanesulfonic acid is methanesulfonic acid.

* * * * *